US008175320B2

(12) United States Patent
Lin et al.

(10) Patent No.: US 8,175,320 B2
(45) Date of Patent: May 8, 2012

(54) SINGLE MAGNET COAXIAL LOUDSPEAKER

(75) Inventors: Chun-Yi Lin, Xinzhuang (TW); Yoichiro Sumitani, Rancho Palos Verdes, CA (US)

(73) Assignee: Sound Sources Technology, Inc.

( * ) Notice: Subject to any disclaimer, the term of this patent is extended or adjusted under 35 U.S.C. 154(b) by 1260 days.

(21) Appl. No.: 11/769,093

(22) Filed: Jun. 27, 2007

(65) Prior Publication Data

US 2009/0003632 A1 Jan. 1, 2009

(51) Int. Cl.
*H04R 1/00* (2006.01)
*H04R 9/06* (2006.01)

(52) U.S. Cl. ..... 381/401; 381/421

(58) Field of Classification Search ..... 381/401, 381/421

See application file for complete search history.

(56) References Cited

U.S. PATENT DOCUMENTS

| | | | | |
|---|---|---|---|---|
| 2,269,284 | A | 1/1942 | Olson | |
| 4,220,832 | A | 9/1980 | Nagel | |
| 4,283,606 | A | 8/1981 | Buck | |
| 4,552,242 | A | 11/1985 | Kashiwabara | |
| 4,811,406 | A | 3/1989 | Kawachi | |
| 5,193,119 | A | 3/1993 | Tontini et al. | |
| 5,295,194 | A | 3/1994 | Christensen | |
| 5,604,815 | A | 2/1997 | Paddock | |
| 5,629,501 | A | 5/1997 | Fenton | |
| 5,802,191 | A | 9/1998 | Guenther | |
| 6,963,650 | B2 | 11/2005 | Combest | |
| 6,963,651 | B2 * | 11/2005 | Peng | 381/401 |
| 2005/0271236 | A1 | 12/2005 | Kobayashi et al. | |

* cited by examiner

*Primary Examiner* — Brian Ensey
(74) *Attorney, Agent, or Firm* — Stetina Brunda Garred & Brucker

(57) ABSTRACT

A coaxial loudspeaker for reproducing an electrical sound signal is provided. The loudspeaker has a magnetic driver assembly with a first annular slot and an opposed, coaxial second annular slot, each establishing a permanent magnetic field therein from a single magnet. Independently driven first and second voice coils are positioned within the respective one of the first and second annular slots, each being connected to a transducer element.

19 Claims, 5 Drawing Sheets

SINGLE MAGNET COAXIAL LOUDSPEAKER

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention relates generally to acoustic transducers. More particularly, the present invention relates to coaxial loudspeaker drivers having independent voice coil elements each being driven by a single magnet.

2. Related Art

Loudspeakers, or acoustic transducers, are universally known and utilized in sound reproduction systems. Essentially, loudspeakers convert electrical energy to acoustic energy according to any one of a variety of well-understood operational principles. Such operational principles are embodied in various designs generally categorized as electrodynamic, electrostatic, piezoelectric, or discharge, among others.

The most common type of loudspeaker is of the electrodynamic variety, in which an electrical signal representative of the specified audio is applied to a voice coil wound around a bobbin and suspended between opposite poles of a magnet. The region between the poles is known as the air gap, and the magnetic field present therein interacts with the electrical signal conducted through the voice coil. The electromagnetic force moves the voice coil, and thus the bobbin, within the air gap, and the displacement or movement thereof is controlled by the magnitude and direction of current in the voice coil and the resulting axial forces. The bobbin is also attached to a cone-shaped semi-rigid diaphragm, and the vibration of the bobbin is correspondingly transferred to the diaphragm. The vibration of the diaphragm causes pressure differences in the surrounding air, thereby producing sound. The base of the diaphragm is flexibly suspended from the mm of the loudspeaker basket, thereby allowing constrained movement while providing lateral stability.

In general, loudspeaker designs aim for faithful re-creation of the sound or acoustic waveform represented by the electrical signal. The typical acoustic waveform is a combination of continuous waveforms of different magnitudes, frequencies, and phases. In this regard, the electrodynamic loudspeaker was characterized by a number of advantages over other designs, including a wide frequency range and efficiency. However, a single loudspeaker cannot reproduce sounds across the entire audible frequency range, due to limitations imposed by weight and size of the diaphragm and bobbin. For instance, while a large diaphragm is capable of handling acoustic waveforms of high magnitudes or louder sounds, its increased weight limits the capability to vibrate at higher frequencies. On the other hand, a small diaphragm is capable of vibrating at higher frequencies, but because of its fragility, higher magnitude waveforms may result in tearing or other damage. Essentially, the size and relative density of the diaphragm are to be configured for a particular frequency range of the acoustic waveform. Although so-called full range loudspeakers have been developed, the response at the peripheral frequencies is less than optimal and results in distortion.

To overcome the above-noted deficiencies, a number of solutions have been proposed for achieving optimal sound reproduction as an alternative to so-called full-range loudspeaker drivers. For example, a standalone system may include more than one loudspeaker driver, each being configured for a particular frequency range. The system may include a tweeter, or loudspeaker driver for high frequency sound reproduction, a midrange driver, and a woofer, or loudspeaker driver for low frequency sound/bass reproduction. It is understood that tweeters have a frequency range of approximately 2,000 to 20,000 Hz, midrange drivers have a frequency range of approximately 300 to 5,000 Hz, and woofers have a frequency range of approximately 40 to 1,000 Hz.

Oftentimes it is undesirable or even impractical to utilize more than one loudspeaker driver in a given installation. In response, loudspeakers having a separate tweeter attached in a co-axial relation to the woofer or midrange driver have been conceived, the earliest example of which is U.S. Pat. No. 2,269,284 to Olson. The Olson device contemplates multiple diaphragms of successive size arranged in a nested, overlapping relationship, with one diaphragm being connected to another with a flexible compliance. The voice coils coupled to the respective one of the diaphragms are also in a nested relation. In response to the complexity associated with the interrelated movement of the diaphragms and voice coils in the Olson device, U.S. Pat. No. 5,295,194 to Christensen contemplates the addition of a tweeter to the voice coil bobbin of the woofer. The tweeter of the Christensen device is piezoelectric, and so is driven independently of the woofer. When the voice coil bobbin of the woofer vibrates at a low frequency, so does the entire tweeter. Thus, one diaphragm is mechanically linked to another.

Alternatively, coaxial loudspeaker devices with drivers that were neither linked mechanically not electrically to the other drivers in the device have been contemplated, such as that disclosed in U.S. Pat. No. 4,552,242 to Kashiwabara. The straightforward solution provided for the stacking of one driver on top of another, with each having its own electromagnetic circuit and diaphragm. However, the Kashiwabara device increased the weight and profile of the loudspeaker.

Accordingly, there is a need in the art for an improved coaxial loudspeaker.

BRIEF SUMMARY

In accordance with one embodiment of the present invention, a coaxial loudspeaker for reproducing an electrical sound signal is provided. The coaxial loudspeaker may include a magnetic driver assembly having a top end portion, where the top end portion defines a first annular slot of a first circumference. Additionally, the magnetic driver assembly may have an opposed bottom end portion that defines a second annular slot of a second circumference. The first annular slot may be coaxial with the second annular slot, with each annular slot establishing a permanent magnetic field therein. The coaxial loudspeaker may also include first and second voice coils positioned within the respective one of the first and second annular slots. Each of the first and second voice coils may be axially driven based upon interactions between the electrical sound signal delivered thereto and the corresponding one of the permanent magnetic fields. It is contemplated that the first voice coil is driven independently of the second voice coil.

An embodiment of the coaxial loudspeaker may also include a cylindrical yoke with a cylinder body and a top inward flange. Further, the coaxial loudspeaker may include a top pole piece having a pole body and a bottom outward flange, where the cylindrical yoke is coupled to the top pole piece. The coaxial loudspeaker may also include a ring magnet attached to the cylindrical yoke and the top pole piece. A portion of the pole body may be spaced in an opposed relation to the top inward flange to define the first annular slot. Further, a portion of the cylinder body may be spaced in an opposed relation to the bottom outward flange to define the second annular slot.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. It is understood that the use of relational terms such as first and second, top and bottom, and the like are used solely to distinguish one from another entity without necessarily requiring or implying any actual such relationship or order between such entities.

Figures 1, 2:
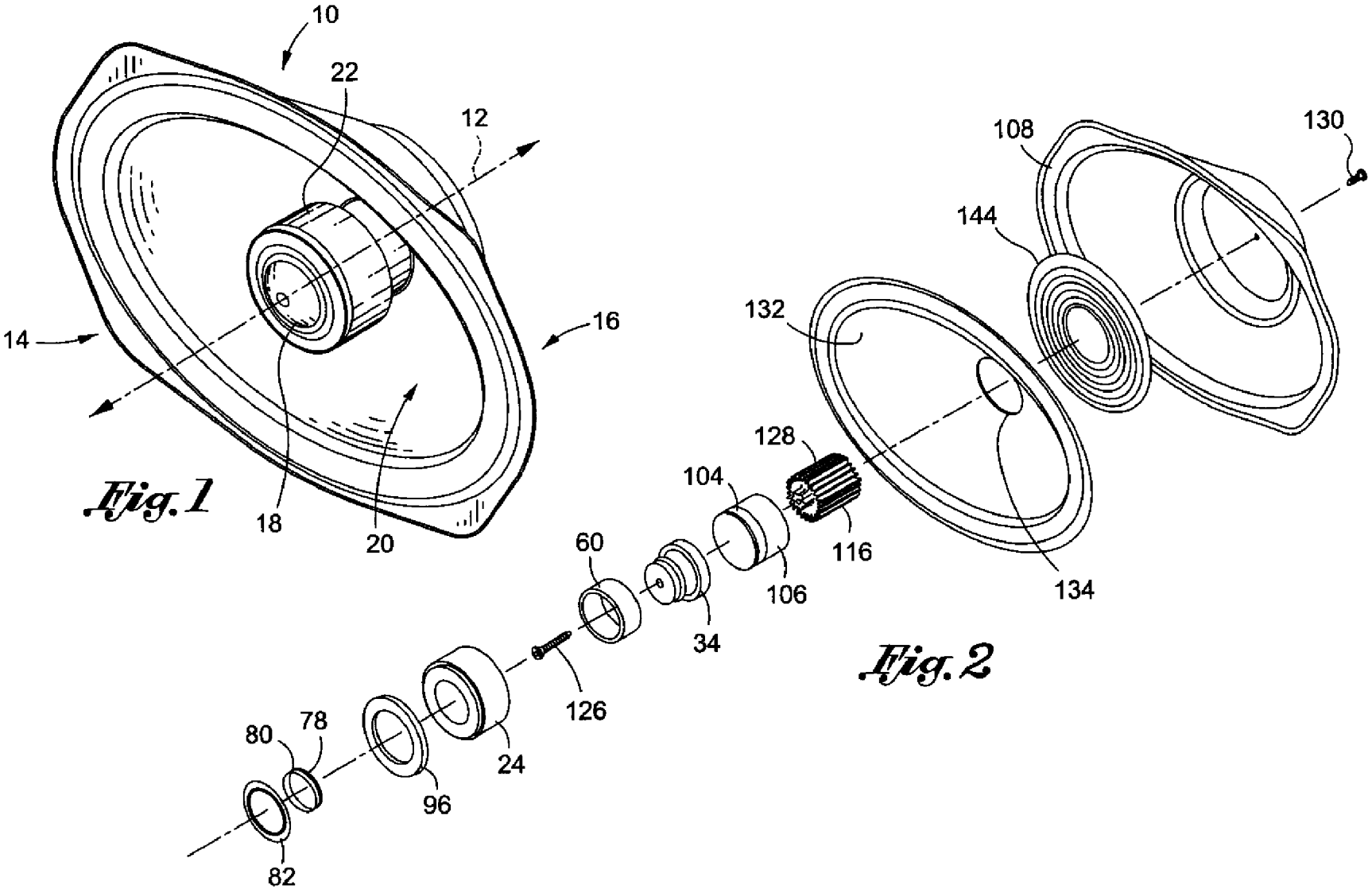
FIG. 1 is a perspective view of the coaxial loudspeaker in accordance with a first embodiment of the present invention.
FIG. 2 is an exploded perspective view of each of the components of the coaxial loudspeaker.

With reference to FIG. 1, a coaxial loudspeaker 10 in accordance with a first embodiment of the present invention defines a primary axis 12, a front portion 14, and an opposite back portion 16. Further, the coaxial loudspeaker 10 includes a tweeter 18 and a woofer 20 that are both aligned along the primary axis 12. As described above in the background, the coaxial loudspeaker 10 is provided with a composite electrical signal that is representative of sound, which is generally comprised of high frequency components and low frequency components. It is understood that the tweeter 18 reproduces the high frequency sound components, while the woofer reproduces the low frequency sound components. In this regard, the composite electrical signal is filtered via a passive or active crossover prior to delivery to the respective one of the tweeter 18 and the woofer 20. As will be described in further detail below, the tweeter 18 and the woofer 20 are coupled to a magnetic driver assembly 22.

Figure 3:
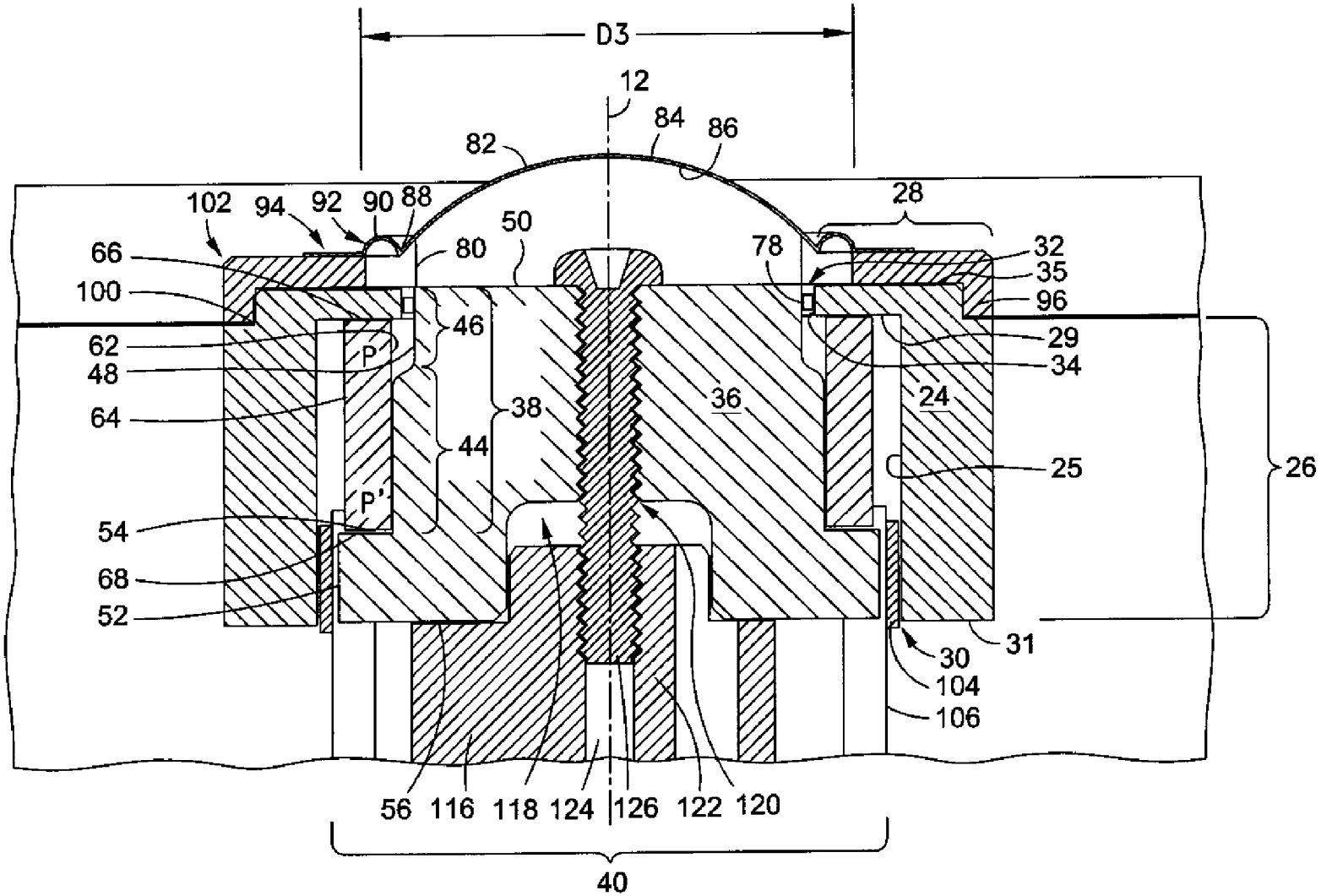
FIG. 3 is a cross-sectional view of the magnetic driver assembly of the coaxial loudspeaker including a top pole piece, an annular magnet, and a cylindrical yoke in accordance with one embodiment of the present invention.

Referring to FIGS. 2 and 3, the magnetic driver assembly 22 includes a cylindrical yoke 24. As best shown in the cross-sectional view of the magnetic driver assembly 22 in FIG. 3, the cylindrical yoke 24 has a cylinder body 26 and a top inward flange 28. Generally, the cylindrical yoke 24 is defined by an open bottom end portion 30 with a base surface 31, and a constricted top end portion 32 that includes the top inward flange 28. The interior of the cylindrical yoke 24 is defined by a yoke wall 25 and a generally perpendicular inner surface 29 of the top inward flange 28. The top inward flange 28 defines an inner flange lip 34, which extends in a parallel relation to the yoke wall 25, and serves as an opening to the interior of the cylindrical yoke 24. The top inward flange 28 further defines a top flange surface 35, the details of which will be described below.

The magnetic driver assembly 22 also includes a top pole piece 36 that has a pole body 38 and a bottom outward flange 40. In further detail, the pole body 38 is segregated into a first section 44 and a narrowed second section 46. The pole body also defines an outer surface 48 that is perpendicular to a top surface 50. The bottom outward flange 40 defines an outer flange lip 52 that extends in a parallel relation to the outer surface 48, an upper horizontal flange surface 54, and an opposed bottom horizontal flange surface 56.

The cylindrical yoke 24 is receptively coupled to the top pole piece 36, and connected via an annular magnet 60. The magnet 60 defines an inner circumference 62 and an outer circumference 64, and connecting the inner and outer circumferences 62, 64 and extending in a perpendicular relation thereto are a top magnet surface 66 and an opposed bottom magnet surface 68. The annular magnet 60 is coupled to the top pole piece 36 in a sleeved relationship, and thus the inner circumference 62 of the annular magnet 60 faces the outer surface 48 of the top pole piece 36. The bottom outward flange 40 of the top pole piece 36 is attached to the annular magnet 60, specifically, the upper horizontal flange surface 54 is in frictional engagement with the bottom magnet surface 68. Further, the top inward flange 28 of the cylindrical yoke 24 is attached to the annular magnet 60, where the top magnet surface 66 is in frictional engagement with the inner surface 29. The outer circumference 64 faces the yoke wall 25 in this configuration. It is contemplated that the thickness of the magnet 60 is such that upon engagement to the cylindrical yoke 24 and the top pole piece 36, the top flange surface 35 is coplanar with the top surface 50, and the base surface 31 is coplanar with the bottom horizontal flange surface 56.

Figure 4A:
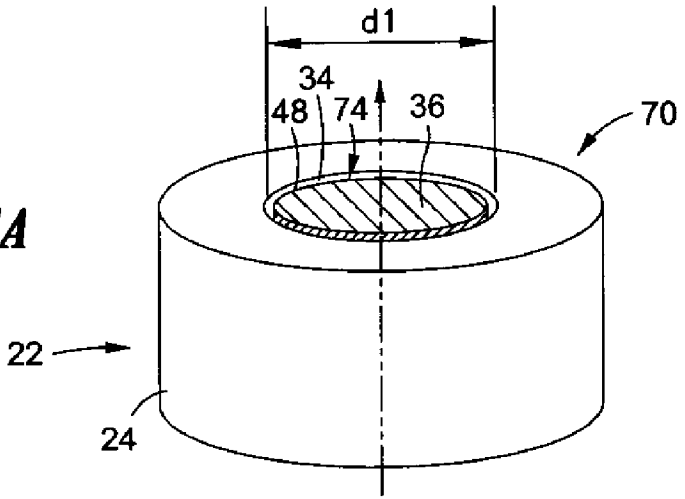
FIGS. 4*a* and 4*b* are perspective views of the magnetic driver assembly, illustrating the differences between a first annular slot on the top end portion and a second annular slot on the bottom end portion.
Figure 4B:
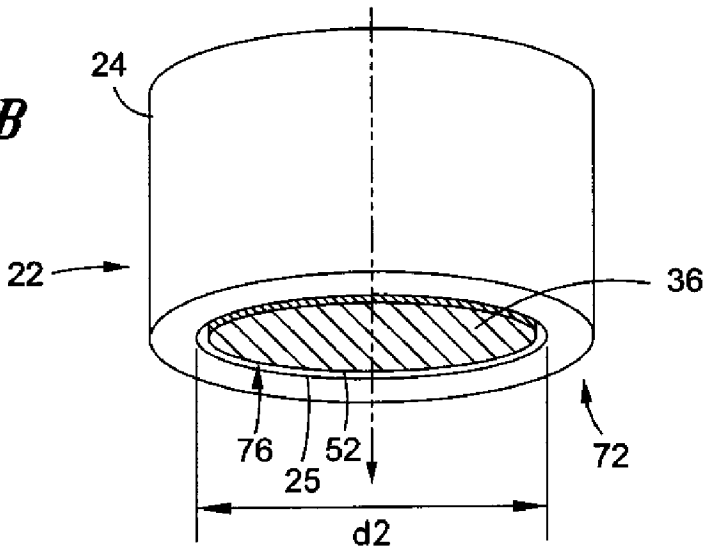

It is noted that the cylindrical yoke 24 and the top pole piece 36 are connected through the annular magnet 60, and thus the magnetic driver assembly 22 includes annular slots defined by its constituent parts. In further detail as illustrated in FIGS. 4*a* and 4*b*, magnetic driver assembly 22 is defined by a top end portion 70 and an opposed bottom end portion 72. As best shown in FIG. 4*a*, the inner flange lip 34 of the cylindrical yoke 24 and the outer surface 48 of the top pole piece 36 defines a first annular slot 74 of a first diameter D1. With reference to FIG. 4*b*, the outer flange lip 52 of the top pole piece 36 and the yoke wall 25 defines a second annular slot 76 of a second diameter D2. It is contemplated that the first annular slot 74 is coaxial with the second annular slot 76. According to one embodiment of the present invention, the first diameter D1 is less than the second diameter D2, for reasons that will be explained in further detail below.

In addition to mechanically linking the cylindrical yoke 24 to the top pole piece 36, the annular magnet 60 generates a magnetic field within the first and second annular slots 74, 76. As best illustrated in FIG. 3, the top magnet surface 66 has a first polarity P, while the bottom magnet surface 68 has an opposite second polarity P'. Therefore, because the cylindrical yoke 24 is magnetically coupled to the top surface 66, it likewise has the first polarity P. Furthermore, because the top pole piece 36 is magnetically coupled to the bottom magnet surface 68, it has the second polarity P'. The magnetic flux thus flows from the inner flange lip 34 of the cylindrical yoke 24 to the outer surface 48 of the top pole piece 36, and from the yoke wall 25 to the outer flange lip 52 of the top pole piece 36. In this regard, it will be recognized by those having ordinary skill in the art that the first annular slot 74 and the second annular slot 76 are referred to as air gaps. According to one embodiment, the annular magnet 60 is a rare earth permanent magnet, preferably of the neodymium type.

Positioned within the first annular slot 74 or air gap is a first or tweeter voice coil 78. More particularly, the tweeter voice coil 78 is a coil of lightweight wire wrapped around a first bobbin 80, and has one or more lead lines connected to an electrical signal source. As explained above, the electrical signal transmitted through the tweeter voice coil 78 interacts with the permanent magnet field in the first annular slot 74, thereby driving the first bobbin 80 in a reciprocating manner along the primary axis 12. Opposite the tweeter voice coil 78, the first bobbin 80 is attached to a tweeter dome 82, which defines a convex outer surface 84 and an opposed concave inner surface 86. The tweeter dome 82 is further defined by an outer rim region 88, to which the first bobbin 80 is attached. The outer rim region 88 is also attached to a flexible tweeter surround 90 having an arcuate compliant portion 92, and a flat linking portion 94. It is understood that the flexible tweeter surround 90 supportively suspends the first bobbin 80, and thus the tweeter voice coil 78, within the first annular slot 74 while allowing limited movement therein.

A top plate 96 vertically offsets the tweeter surround 90 and the tweeter dome 82 from top flange surface 35 to provide sufficient excursion space for the first bobbin 80. The top plate 96 defines an inner rim 98 that has a third diameter D3 that is greater than the first diameter D1. The inner rim 98 defines an opening with which the first bobbin 80 is aligned. The top plate 96 is cooperatively engaged to the cylindrical yoke 24. In particular, the cylindrical yoke 24 defines a notched corner shoulder 100 in the junction between the top inward flange 28 and the substantially perpendicular cylinder body 26. Along these lines, the top plate 96 includes a perpendicular lip 102 or outer rim that is sized and configured to mate with the notched corner shoulder 100. It is contemplated that the combined structure of the perpendicular lip 102 and the notched corner shoulder 100 centers the top plate 96 about the primary axis 12, so long as the cylindrical yoke 24 is centered about the primary axis 12 as well.

It is to be understood that the tweeter 18 includes the aforementioned tweeter voice coil 78, the first bobbin 80, the tweeter dome 82, the flexible tweeter surround 90, and the top plate 96. As indicated above, the tweeter 18 is understood to reproduce a first or high frequency range. Thus, first frequency components of the composite electrical signal are transmitted to the tweeter voice coil 78, which interacts with the permanent magnet and causes the first bobbin 80 to vibrate at the first or high frequency range. Vibration of the first bobbin 80, in turn, is translated into a corresponding vibration of the tweeter dome 82. One of ordinary skill in the art will be able to ascertain the appropriate materials with which the tweeter dome 82 is constructed, and are generally characterized by an optimal combination of rigidity, low weight, and high damping. Such materials include titanium, silk, paper, or fabric.

Figure 5:
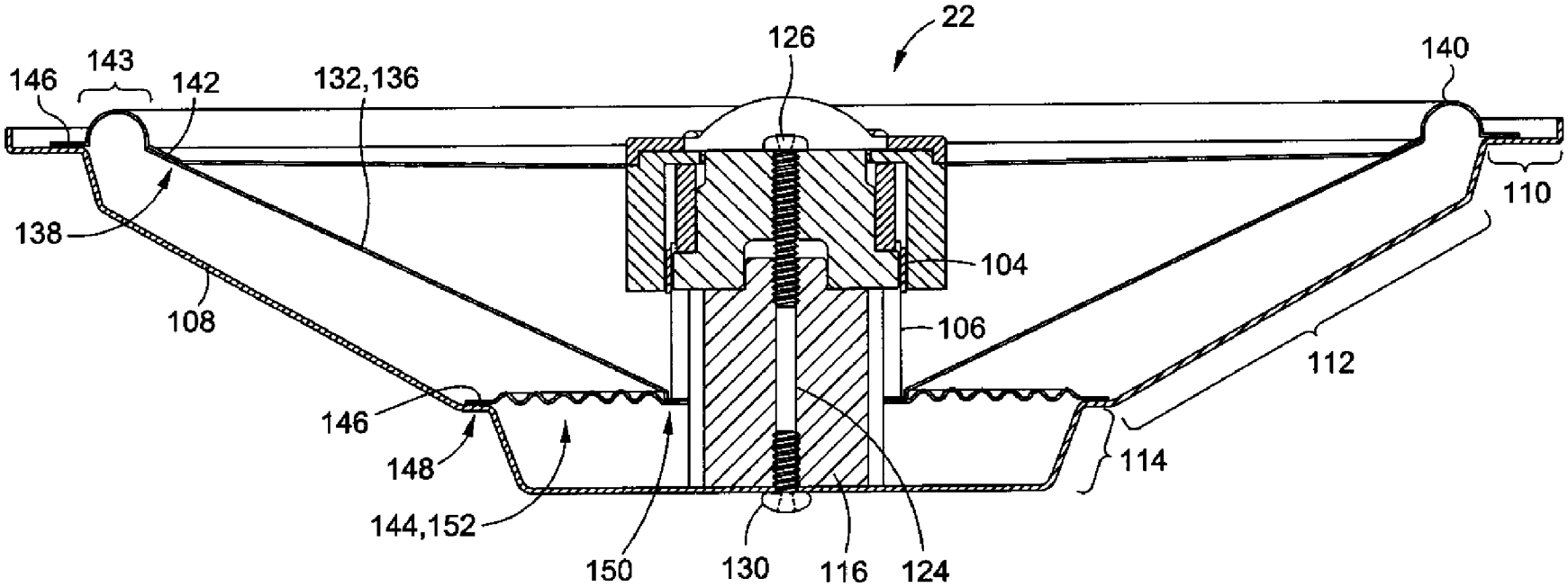
FIG. 5 is a cross-sectional view of the coaxial loudspeaker including the tweeter and the woofer having a common magnetic driver assembly in accordance with one embodiment of the present invention.
Figure 6:
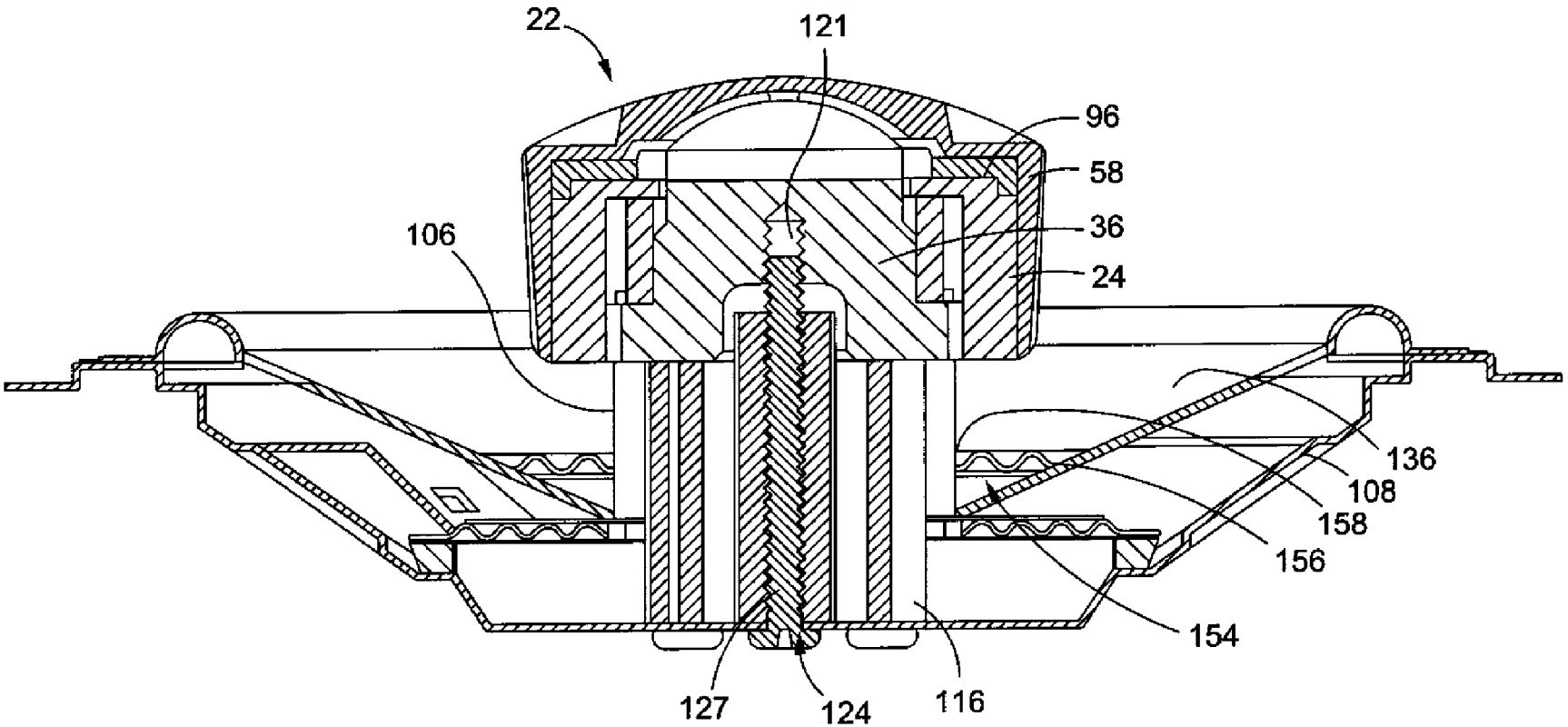
FIG. 6 is a cross-sectional view of a second embodiment of the coaxial loudspeaker including an additional support spider attached to the concave front face of a woofer diaphragm.

In one embodiment, the magnetic driver assembly 22 may be bare as illustrated in FIG. 5 with the cylindrical yoke 24, the top plate 96, and the convex outer surface 84 of the tweeter dome 82 exposed. As shown in FIG. 6, however, a cover 58 may conceal such components. The face of the cover 58 may be provided with various ornamental features that improve the aesthetic appearance of the coaxial loudspeaker 10.

Positioned within the second annular slot 76 is a second or woofer voice coil 104 wound to a second bobbin 106. As described in relation to the tweeter voice coil 78, the woofer voice coil 104 is likewise a coil of lightweight wire wrapped around the second bobbin 106. The woofer voice coil 104 includes one or more lead lines connected to an electrical signal source. The electrical signal conducted through the woofer voice coil 104 interacts with the permanent magnetic field in the second annular slot 76, thereby driving the second bobbin 106 in a reciprocating manner along the primary axis 12.

With reference to FIGS. 2 and 5, the coaxial loudspeaker 10 includes a frustoconical basket 108 defined by a flat frontal rim 110, a tapered body portion 112, and a rear base 114. As explained above in relation to FIG. 1, the coaxial loudspeaker 10 is characterized by a front portion 14 and a back portion 16, which generally corresponds to the flat frontal rim 110 and the rear base 114, respectively. The magnetic driver assembly 22 is attached to the rear base 114 with a bottom pole piece 116. More particularly, and with reference to FIG. 3, in the first embodiment the top pole piece 36 defines a central indentation 118 and a fully extensive central bore 120 coaxial thereto. The bottom pole piece 116, in turn, defines a corresponding mating member 122, which is inserted into the central indentation 118. The bottom pole piece 116 also defines a central bore 124 that is coaxial with the central bore 120 of the top pole piece 36. A fastener 126, which by way of example only and not of limitation is illustrated as a screw, is threaded through the central bore 120 of the top pole piece 36, through the central bore 124 of the bottom pole piece 116. It will be appreciated by those having ordinary skill in the art that any other type of fastener may be readily substituted without departing from the scope of the present invention. According to one embodiment of the present invention, the bottom pole piece includes a plurality of fins 128 for improved heat dissipation characteristics. As best illustrated in FIG. 5, the central bore 124 extends the entire height of the bottom pole piece 116, and a second fastener 130 mounts the bottom pole piece 116 to the rear base 114 of the frustoconical basket 108. In the second embodiment illustrated in FIG. 6, a central bore 121 of the top pole piece 36 does not extend the entire height thereof. Accordingly, a fastener 127 extends upwards from the back of the rear base 144, through the central bore 124 of the bottom pole piece 116, and into central bore 121, thereby linking the bottom pole piece 116 to the top pole piece 36.

The second bobbin 106 is understood to have a diameter larger than that of the bottom pole piece 116, and is in a sleeved relation to the same. The woofer voice coil 104 is attached to a top end of the second bobbin 106, and the opposed bottom end is attached to a woofer diaphragm 132. The woofer diaphragm 132 defines a central opening 134 best shown in FIG. 2, a concave front face 136, and an outer perimeter 138. In further detail, the second bobbin 106 has substantially the same diameter and circumference as the central opening 134, and thus, the second bobbin 106 is frictionally retained therein. Along these lines, it is contemplated that the bottom pole piece 116 extends through the central opening 134.

The woofer diaphragm 132 is suspended from the flat frontal rim 110 via a woofer suspension 140. It is understood that the woofer suspension 140 is defined by a rigid inner rim 142, a flexible portion 143 having an arcuate cross section, and a rigid outer rim 146. The rigid inner rim 142 is attached to the outer perimeter 138 of the woofer diaphragm 132, while the rigid outer rim 146 is attached to the flat frontal rim 110 of the frustoconical basket 108. As will be appreciated by those having ordinary skill in the art, the woofer suspension 140 may be constructed of any sufficiently flexible material such as foam or rubber. Thus, the woofer diaphragm 132 may vibrate along the primary axis 12 in conjunction with the second bobbin 106, subject to the flexing limitations of the woofer suspension 140.

Further lateral support of the second bobbin 106 and the woofer diaphragm 132 is provided by a first annular damper 144, otherwise known in the art as a spider. The first annular damper 144 is defined by an outer rim 146 attached to a ledge 148 of the basket 108, and an inner rim 150 attached to the junction between the second bobbin 106 and the woofer diaphragm 132. The first annular damper 144 includes a corrugated center portion 152 that limits the lateral excursion of the second bobbin 106. Additionally, with reference to FIG. 6, the lateral support of the second bobbin 106 may be further enhanced with a second annular damper 154. It is contemplated that the second annular damper 154 defines an outer rim 156 attached to the concave front face 136 of the woofer diaphragm 132, and an inner rim 158 attached to the second bobbin 106. In order to maximize stabilization, the second annular damper 154 is attached at around the midpoint between the woofer voice coil 104 and the attachment point to the first annular damper 144 and the woofer diaphragm 132.

The woofer 20 includes the aforementioned woofer voice coil 104, the second bobbin 106, the woofer diaphragm 132, the woofer suspension 140, and the first annular damper 144. As indicated above, the woofer 20 is understood to reproduce a second or low frequency range. Thus, second frequency components of the composite electrical signal are transmitted to the woofer voice coil 104, which interact with the permanent magnet. This interaction causes the second bobbin 106 to vibrate at the second or low frequency range, which in turn is translated into a corresponding vibration of the woofer diaphragm 132. The woofer diaphragm 132 may be constructed of paper, polypropylene, carbon-fiber composite material, hemp, Kevlar, or any other sufficiently lightweight yet resilient material suitable for acoustic applications. Although in the illustrative embodiment of the present invention the face of the frustoconical basket 108 and the woofer diaphragm 132 is elliptical in shape, it will be appreciated that other shapes, such as circular shapes, are within the scope of the present invention.

As indicated above, the first annular slot 74 is located on the top end portion 70 of the magnetic driver assembly 22, while the second annular slot 76 is located on the bottom end portion 72 of the same. Accordingly, it is understood that the tweeter voice coil 78 is vertically offset relative to the woofer voice coil 104. It is contemplated that while the axial movement of the tweeter voice coil 78 is independent of the woofer voice coil 104 because the two are electrically isolated, the single source of the permanent magnetic flux with which they interact is the annular magnet 60. In other words, both the tweeter voice coil 78 and the woofer voice coil 104 are driven by a single magnet, i.e., the annular magnet 60. Accordingly, the overall profile and weight of the coaxial loudspeaker 10 is reduced. As illustrated in FIG. 5, the first bobbin 80 extends in an upward direction magnetic driver assembly 22 to attach to the transducer element or the tweeter dome 82, while the second bobbin 106 extends in a downward direction to attach to the transducer element or woofer diaphragm 132. The first and second bobbins 80, 106 remain in a coaxial relationship.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A coaxial loudspeaker for reproducing an electrical sound signal comprising:

a magnetic driver assembly having a top end portion defining a first annular slot of a first circumference and an opposed bottom end portion defining a second annular slot of a second circumference, the first annular slot being coaxial with the second annular slot, and each annular slot establishing a permanent magnetic field therein, the magnetic driver assembly including:

a cylindrical yoke having a cylinder body and a top inward flange;

a top pole piece having a pole body and a bottom outward flange, the cylindrical yoke being coupled to the top pole piece; and a ring magnet attached to the cylindrical yoke and the top pole piece;

wherein a portion of the pole body is spaced in an opposed relation to the top inward flange to define the first annular slot, and a portion of the cylinder body is spaced in an opposed relation to the bottom outward flange to define the second annular slot; and first and second voice coils positioned within the respective one of the first and second annular slots;

wherein each of the first and second voice coils are axially driven based upon interactions between the electrical sound signal delivered thereto and the corresponding one of the permanent magnetic fields, the first voice coil being driven independently of the second voice coil.

2. The coaxial loudspeaker of claim 1, wherein the circumference of the first annular slot is less than the circumference of the second annular slot.

3. The coaxial loudspeaker of claim 1, wherein:

the ring magnet is defined by a top face and an opposed bottom face; and the top face being attached to the top inward flange of the top pole piece and the bottom face being attached to the bottom outward flange of the cylindrical yoke, thereby coupling the cylindrical yoke to the top pole piece.

4. The coaxial loudspeaker of claim 3, wherein:

the top face of the ring magnet and the cylindrical yoke directly interfaced thereto has a first polarity;

the bottom face of the ring magnet and the top pole piece directly interfaced thereto has a second opposed polarity; and the first and second opposed polarities in the cylindrical yoke and the top pole piece generating the permanent magnetic fields in the first and second annular slots.

5. The coaxial loudspeaker of claim 1, wherein the electrical sound signal includes a first frequency range and a second frequency range, the first voice coil having delivered thereto the electrical sound signal in the first frequency range and the second voice coil having delivered thereto the electrical sound signal in the second frequency range.

6. The coaxial loudspeaker of claim 5, further comprising:

an annular top plate attached to the cylindrical yoke, the annular top plate defining an inner rim having a circumference greater than the circumference of the first annular slot;

a first bobbin to which the first voice coil is attached;

a tweeter dome coupled to the first bobbin; and a tweeter suspension coupled to the inner rim of the annular top plate and the tweeter dome;

wherein the vibration of the tweeter dome resulting from the first voice coil being driven reproduces a sound in the first frequency range.

7. The coaxial loudspeaker of claim 6, wherein:

the yoke includes a notched corner shoulder; and the top plate further defines an outer rim in cooperative engagement with the notched corner shoulder to axially align the top plate and the yoke.

8. The coaxial loudspeaker of claim 5, further comprising:

a basket defined by a front rim and a rear base;

a bottom pole piece fixed to the rear base of the basket and the top pole piece;

a second bobbin to which the second voice coil is attached; and a woofer diaphragm coupled to the second bobbin and suspended from the front rim of the basket;

wherein the vibration of the woofer cone resulting from the second voice coil being driven reproduces a sound in the second frequency range.

9. The coaxial loudspeaker of claim 8, further comprising:

a first annular damper defining an outer rim and an inner rim, the outer rim being attached to the basket and the inner rim being attached to the second bobbin and the woofer diaphragm.

10. The coaxial loudspeaker of claim 9, further comprising:

a second annular damper defining an outer rim and an inner rim, the outer rim being attached to the woofer diaphragm and the inner rim being attached to the second bobbin intermediate the second voice coil and the first annular damper along the length thereof.

11. A coaxial loudspeaker, comprising:

a cylindrical yoke defined by an open bottom end portion and an opposed top end portion, the top end portion having an inner flange;

a top pole piece defining a body portion and an outwardly flanged base portion;

an annular magnet coupled to the top pole piece in a sleeved relationship and received within the cylindrical yoke, the outwardly flanged base portion of the top pole piece and the inner flange of the cylindrical yoke being attached to the annular magnet;

a first voice coil assembly suspended within a first air gap defined by the inner flange of the cylindrical yoke and the body portion of the top pole piece; and a second voice coil assembly suspended within a second air gap defined by the outwardly flanged based portion of the top pole piece and the open bottom end portion of the cylindrical yoke;

wherein the first voice coil assembly is vertically offset and coaxial relative to the second voice coil assembly.

12. The coaxial loudspeaker of claim 11, wherein the first voice coil assembly includes:

a first cylindrical bobbin defining a cylinder axis; and a first voice coil wound on the first cylindrical bobbin, the voice coil having lead lines connectable to a source to deliver an electrical signal therethrough, the voice coil being positioned within the first air gap to interact with a permanent magnetic field therein to produce movement of the first voice coil assembly along the cylindrical axis based upon the electrical signal.

13. The coaxial loudspeaker of claim 12, further comprising:

an annular top plate attached to the top end portion of the cylindrical yoke in a coaxial relation thereto;

a first diaphragm fixed to the first cylindrical bobbin; and a first flexible suspension attached to the annular top plate and the tweeter dome.

14. The coaxial loudspeaker of claim 13, wherein the first diaphragm is a tweeter dome for reproducing high frequency sound components of the electrical signal.

15. The coaxial loudspeaker of claim 11, wherein the second voice coil assembly includes:

a second cylindrical bobbin defining a cylinder axis; and a second voice coil wound on the second cylindrical bobbin, the voice coil having lead lines connectable to a source to deliver an electrical signal therethrough, a permanent magnetic field in the second air gap interacting with the electrical signal to produce movement of the second voice coil assembly along the cylindrical axis based upon the electrical signal.

16. The coaxial loudspeaker of claim 15, further comprising:

a frustoconical basket defining a front rim portion and a rear base portion;

a bottom pole piece coupled to the base portion of the top pole piece and the rear base portion of the basket;

a second diaphragm defining a central opening, a concave front face, and an outer perimeter, the second cylindrical bobbin being fixed to the second diaphragm at a portion thereof defining the perimeter of the central opening; and a second flexible suspension having a first section attached to the front rim portion of the basket and a second section attached to the outer perimeter of the second diaphragm;

wherein the bottom pole piece extends through the central opening of the second diaphragm.

17. The coaxial loudspeaker of claim 16, wherein the second diaphragm is a woofer cone for reproducing low frequency sound components of the electrical signal.

18. The coaxial loudspeaker of claim 16, further comprising:

a corrugated annular damper defining an outer rim and an inner rim, the outer rim being attached to the basket and the inner rim being attached to the second cylindrical bobbin and the second diaphragm.

19. The coaxial loudspeaker of claim 16, wherein bottom pole piece includes a plurality of radially disposed fins for heat dissipation.

* * * * *